US011069460B1

(12) United States Patent
Fallahmohammadi et al.

(10) Patent No.: US 11,069,460 B1
(45) Date of Patent: Jul. 20, 2021

(54) FIRE RESISTANT CABLE WITH DUAL INSULATION LAYER ARRANGEMENT

(71) Applicant: Prysmian S.p.A., Milan (IT)

(72) Inventors: Ehsan Fallahmohammadi, Lexington, SC (US); Clint Nicholaus Anderson, Lexington, SC (US)

(73) Assignee: Prysmian S.p.A., Milan (IT)

( * ) Notice: Subject to any disclaimer, the term of this patent is extended or adjusted under 35 U.S.C. 154(b) by 0 days.

(21) Appl. No.: 16/990,250

(22) Filed: Aug. 11, 2020

(51) Int. Cl.

| | |
|---|---|
| ***H01B 7/02*** | (2006.01) |
| ***H01B 7/295*** | (2006.01) |
| ***H01B 3/46*** | (2006.01) |
| ***H01B 3/28*** | (2006.01) |
| ***H01B 3/04*** | (2006.01) |

(52) U.S. Cl.
CPC ..... *H01B 7/295* (2013.01); *H01B 3/04* (2013.01); *H01B 3/28* (2013.01); *H01B 3/46* (2013.01)

(58) Field of Classification Search
CPC ..... H01B 7/002; H01B 7/04; H01B 7/295; H01B 7/0275; H01B 7/28; H01B 1/026
USPC ..... 174/110 R, 120 R, 120 SR, 121 R, 174/121 SR
See application file for complete search history.

(56) References Cited

U.S. PATENT DOCUMENTS

| | | | | |
|---|---|---|---|---|
| 10,453,588 | B2 | 10/2019 | Blair et al. | |
| 2002/0117325 | A1* | 8/2002 | Mennone | H01B 7/295 174/121 A |
| 2006/0068201 | A1* | 3/2006 | Alexander | C08K 3/34 428/357 |
| 2013/0062097 | A1* | 3/2013 | Hammond | H01B 3/46 174/120 SR |
| 2014/0008098 | A1* | 1/2014 | Scaglione | H01B 7/2825 174/107 |
| 2015/0060106 | A1* | 3/2015 | Polasky | B32B 27/08 174/110 S |
| 2015/0147571 | A1* | 5/2015 | Alexander | C08L 83/04 428/391 |
| 2016/0329129 | A1* | 11/2016 | Osborne, Jr. | H01B 7/295 |

FOREIGN PATENT DOCUMENTS

JP H11-176249 A 7/1999

* cited by examiner

*Primary Examiner* — William H. Mayo, III
(74) *Attorney, Agent, or Firm* — Ulmer & Berne LLP

(57) ABSTRACT

A fire resistant cable includes cable at least one conductor and at least one mica layer surrounding the at least one conductors. The fire resistant cable further includes a first layer of insulation surrounding the at least one mica layer and a second layer of insulation surrounding the first layer of insulation. The first and second layers of insulation are made of a composition based on a flame retardant ceramifiable silicone rubber. The second layer of insulation further contains a reinforcement material.

13 Claims, 1 Drawing Sheet

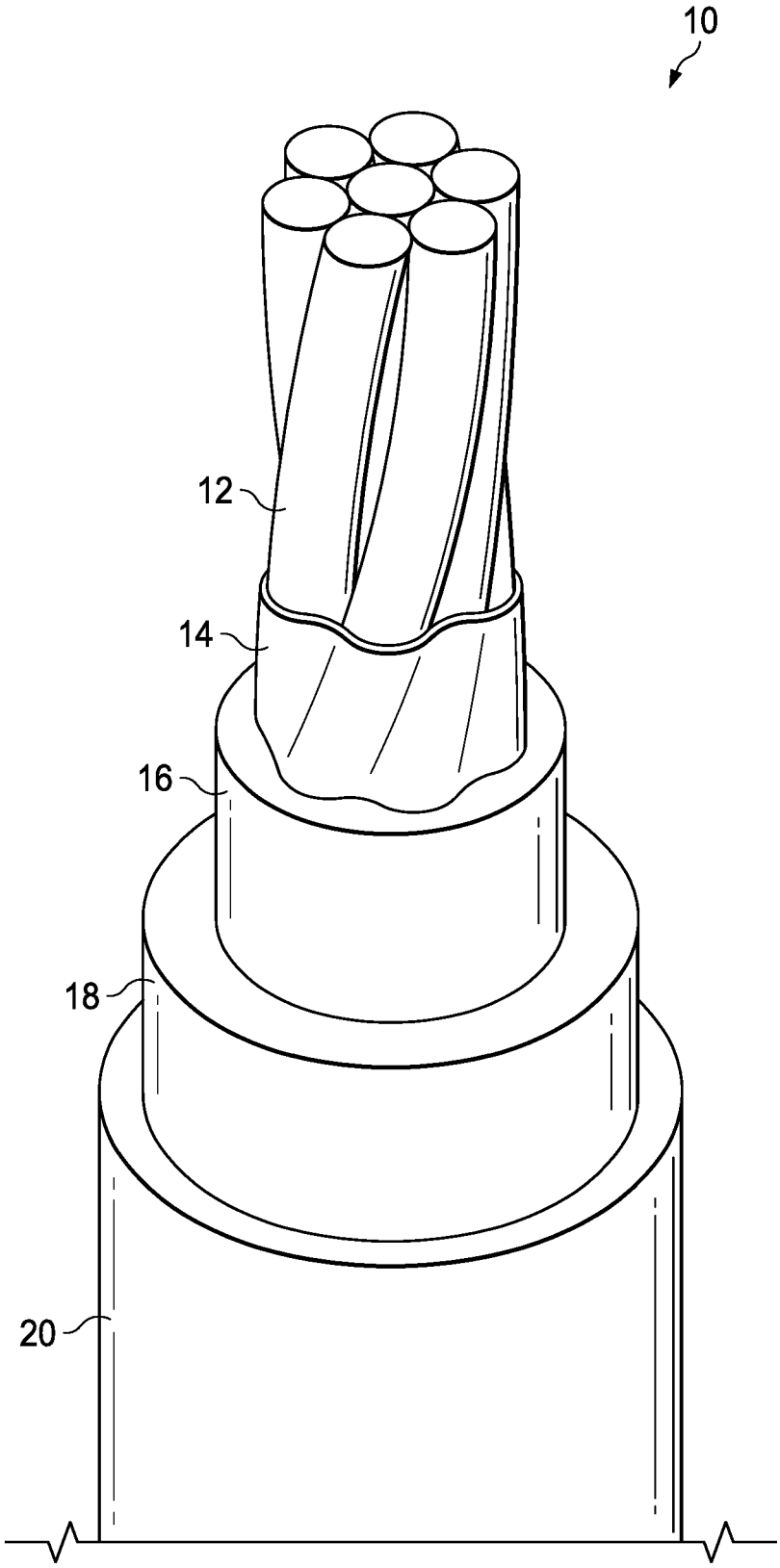
10
12
14
16
18
20

FIRE RESISTANT CABLE WITH DUAL INSULATION LAYER ARRANGEMENT

FIELD OF THE INVENTION

The present application relates to fire resistant cables. More specifically, the present application relates to cables for the transmission or distribution of low-voltage power and/or for data transmission, is endowed with fire resistance properties and include two insulation layers that facilitate the cable's ability to maintain circuit integrity at high temperatures.

BACKGROUND OF THE INVENTION

Cables generally include one or more coatings surrounding conductive elements to provide the cables such features as electrical insulation and improved durability. The coatings, usually in the form of insulation and jackets, may exhibit properties suitable for the intended use of the cable and meet requirements to be certified under national and international standards. Fire resistant cables, for example, are required pass testing to show operating capacity in the presence of fire for at least a specific duration in order to meet the requirements of certain standards.

Generally, a cable intended to be fire-resistant is provided with one or more coatings made of materials capable of acting as a barrier to prevent or limit exposure of the cable core to heat that, in the event of a fire, for example, can burn the cable insulation and/or compromise the electric conductor performance. For example, a fire-resistant coating may be made of an inorganic material such as mica or glass fiber or of a material that ceramifies when heated.

In Applicant's experience, some cables intending to be fire resistant have failed such testing where burning byproducts have been able to penetrate the insulation layer to cause a short circuit, where production of ash in a surrounding electrical metal tubing ("EMT") has blocked air flow to prevent completion of ceramification of the insulation layer, and where cracking of the insulation caused by the expansion of the conductor has occurred. It has been proposed to prevent the above-described issues by providing a cable with a dual insulation layer capable of maintaining circuit integrity for a two-hour burn test at temperatures greater than 1000° C.

Japanese Patent Publication No. JPH11176249 to Haruyama et al. ("Haruyama") describes a fireproof electric wire including a conductor, a fireproof layer, and an insulator housed in a corrugated metal pipe. Haruyama discloses that the fireproof layer may be a ceramic silicone elastomer, optionally containing mica powder and/or used with a glass mica tape, and that the insulator may be formed of a carbon atom-free silicone rubber or resin.

U.S. Pat. No. 10,453,588 to Blair et al. ("Blair") describes an electrical cable including a conductor and a couple of mica tapes surrounding the conductor. Blair describes a first insulation layer formed of a silicone-based compound, and optionally, a mineral flame-retardant filler. Blair further describes a second insulation layer formed of a polyolefin and/or an ethylene copolymer, and optionally, a non-halogen, inorganic flame-retardant filler. Blair also discloses the use of a low-smoke zero-halogen (LSOH) outer sheath.

U.S. Patent Publication No. 2016/0329129 to Osborne, Jr. et al. ("Osborne") describes an electric wire including a metal conductor; a fire resistant polymer liner, which can be a mica wrap; and an insulation layer, which may be formed of a silicone compound. Osborne discloses that the insulation may be provided in two layers and that one layer may be ceramifiable while the other is non-ceramifiable. Blair also discloses the use of a fire resistant polyethylene jacket.

SUMMARY OF THE INVENTION

Accordingly, an exemplary embodiment of the present invention provides a fire resistant cable comprising at least one conductor; at least one mica layer surrounding and in direct contact with the at least one conductor; a first layer of insulation surrounding and in direct contact with the at least one mica layer, wherein the first layer of insulation is made of a composition based on a flame retardant ceramifiable silicone rubber; and a second layer of insulation surrounding the first layer of insulation, wherein the second layer of insulation is made of a composition based on a flame retardant ceramifiable silicone rubber comprising at least one reinforcement material.

The present invention may also provide a method of forming a fire resistant cable comprising providing at least one conductor; surrounding the at least one conductor with at least one mica layer; extruding a first layer of insulation around the at least one mica layer, the first layer of insulation being made of a composition based on a cured flame retardant ceramifiable silicone rubber; and extruding a second layer of insulation around the first layer of insulation, the second layer of insulation being made of a composition based on a cured flame retardant ceramifiable silicone rubber comprising at least one reinforcement material, wherein the step of extruding the first layer and the step of extruding the second layer are concurrently carried out.

Other objects, advantages and salient features of the invention will become apparent from the following detailed description, which, taken in conjunction with the annexed drawings, discloses embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

FIG. 1 depicts an isometric view of a fire resistant cable having a conductor, a mica layer, a first insulation layer, a second insulation layer, and a jacket layer according to one embodiment.

DETAILED DESCRIPTION OF THE EXEMPLARY EMBODIMENTS

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

The present disclosure, in at least one of the mentioned aspects, can be implemented according to one or more of the present embodiments, optionally combined together.

For the purpose of the present description and of the appended claims, the words "a" or "an" should be read to include one or at least one and the singular also includes the plural unless it is obvious that it is meant otherwise. This is done merely for convenience and to give a general sense of the disclosure.

As will be described herein, fire resistant cable configurations are disclosed that include at least one conductor, at least one mica layer, and dual insulation layers comprising a first layer of insulation and a second layer of insulation. Such cable configurations can further include a jacket layer. Generally, each of the dual insulation layers can be made of a composition based on a cured flame retardant ceramifiable silicone rubber, where the second, or outer, layer of insulation can further include at least one reinforcement material. Such cable configurations can maintain circuit integrity during a two-hour burn test at 1000° C. or greater when tested according to Underwriters Laboratory ("UL") 2196 (2012). Such cables can also meet requirements according to UL 44. The cable configurations can be for the transmission or distribution of low-voltage power and/or for data transmission. In certain embodiments, "low voltage" refers to a voltage of up to 1 kV.

An illustrative fire resistant cable is depicted in FIG. 1. The fire resistant cable in FIG. 1 includes an electric conductor 12, a mica layer 14, a first layer of insulation 16, a second layer of insulation 18, and a jacket layer 20. As can be appreciated, variations are possible.

For example, fire resistant cables can include an electric conductor in form of a plurality of electrically conductive wires (e.g., twisted or in form of a bundle like in FIG. 1) or of a single electrically conductive rod. The conductor, or conductive element, of the cable, can generally include any suitable electrically conducting material. In certain embodiments, suitable, generally electrically conductive metals can include aluminium, copper, and alloys or composites thereof. It will be appreciated that the cable in certain embodiments can further comprise a phase conductor or a neutral conductor. In certain embodiments, the conductor can be sized for specific purposes. For example, a conductor can range from a 0.33 $mm^2$ (22 AWG) conductor to a 21.2 $mm^2$ (4 AWG) cable in certain embodiments. In certain embodiments, the at least one conductor can be sized at 8.36 $mm^2$ (8 AWG).

In certain embodiments, a fire resistant cable includes at least one mica layer (e.g., 14) surrounding a conductor (e.g., 12). For example, in some embodiments, the fire resistant cable can comprise one mica layer; in some embodiments, the fire resistant cable can comprise two mica layers; in some embodiments; in some embodiments, the fire resistant cable can comprise four mica layers; and in other embodiments, the fire resistant cable can comprise more than four mica layers. For example, in one embodiment, the fire resistant cable can comprise four mica layers surrounding the conductor.

The at least one mica layer can be helically applied directly to a surface of the electric conductor. In certain embodiments, the at least one mica layer can be applied such that there is overlap between adjacent windings. In some embodiments, the adjacent windings can have an overlap of 5% or greater; in some embodiments, the windings can have an overlap of 10% or greater; in some embodiments, the windings can have an overlap of 15% or greater; in some embodiments, the windings can have an overlap of 20% or greater; in some embodiments, the windings can have an overlap of 25% or greater; and in some embodiments, windings can have an overlap of 30% or greater. For example, in one embodiment, the fire resistant cable can comprise at least one mica layer helically applied with an overlap of 25%.

According to certain embodiments, two or more insulation layers can be applied over the at least one mica layer. In certain embodiments, and as shown in FIG. 1, a first layer of insulation 16 can surround and directly contact the at least one mica layer (e.g., 14). Moreover, in some embodiments, the first layer of insulation can be in direct contact with an underlying mica layer. The first layer of insulation can be made of a composition based on a cured flame retardant silicone rubber, with no reinforcement material. In certain embodiments, the first layer of insulation can comprise from 90% to 99.9%, by weight, of the ceramifiable silicone rubber; and in certain embodiments, the first layer of insulation can comprise from 95% to 99.5%, by weight, of the ceramifiable silicone rubber.

In addition to the ceramifiable silicone rubber, the first layer of insulation can further include flame retardant additives to enhance the flame retardant properties of the same. In certain embodiments, the first layer of insulation can comprise from 0.05% to 1.0%, by weight, of the flame retardant additives; and in certain embodiments, the first layer of insulation can comprise from 0.5% to 0.8%, by weight, of the flame retardant additives. Suitable examples of flame retardant additives can include phosphorous-containing additives, like red phosphorous or a phosphorous acid ester, and metal hydroxide-based compounds, like aluminum magnesium hydroxide or magnesium hydroxide sulfate hydrate.

In an embodiment, the first layer of insulation including a flame retardant additive can further comprise a compatibilizer to improve the interfacial adhesion between silicone rubber and flame retardant additive. Suitable examples of compatibilizer suitable for the ceramifiable silicone rubber of the can include siloxanes, like organosiloxanes or polyorganosiloxanes. In certain embodiments, the first layer of insulation can comprise from 0.05% to 1.0%, by weight, of the compatibilizer; and in certain embodiments, the first layer of insulation can comprise from 0.5% to 0.8%, by weight, of the compatibilizer.

The first layer of insulation can also include at least one crosslinking agent. In certain embodiments, the first layer of insulation can comprise from 0.1% to 1.0%, by weight, of the crosslinking agents; and in certain embodiments, the first layer of insulation can comprise from 0.3% to 0.5%, by weight, of the at least one crosslinking agent. Suitable examples of crosslinking agents can include peroxide crosslinking agents such as, for example, α,α'-bis(tert-butylperoxy) disopropylbenzene, di(tert-butylperoxyisopropyl)benzene, dicumyl peroxide, and tert-butylcumyl peroxide. Blends of multiple peroxide crosslinking agents can also be used, including, for example, a blend of 1,1-dimethylethyl 1-methyl-1-phenylethyl peroxide, bis(1-methyl-1-phenylethyl) peroxide, and [1,3 (or 1,4)-phenylenebis(1-methylethylidene)] bis(1,1-dimethylethyl) peroxide.

Table 1 provides an example formulation for a first layer of insulation for an example fire resistant cable, prior to curing. Weight percentages of each component for the example first layer of insulation are listed.

TABLE 1

| First Layer Example | |
|---|---|
| Component | Amount (wt. %) |
| Silicone rubber | 98.55 |
| Flame retardant additive + compatibilizer | 1.05 |
| Peroxide crosslinking agent | 0.40 |

As shown in FIG. 1, a second layer of insulation 18 can surround and directly contact the first layer of insulation 16. Moreover, the second layer of insulation can be in direct contact with the underlying first layer of insulation. Like the first layer of insulation, the second layer of insulation can be made of a composition based on a cured ceramifiable silicone rubber. The ceramifiable silicone rubber used to form each of the dual insulation layer of the present disclosure can be heat or moisture cured. For example, in certain embodiments, the second layer of insulation can comprise from 85.0% to 97.0%, by weight, of the ceramifiable silicone rubber; and in certain embodiments, the second layer of insulation can comprise from 88% to 95%, by weight, of the ceramifiable silicone rubber. It will be appreciated that ceramifiable silicone rubbers suitable for the first layer of insulation can also be suitable for the second layer insulation.

The second layer of insulation can also include flame retardant additives to enhance the flame retardant properties of the same. It will further be appreciated that flame retardant additives suitable for the first layer of insulation, and the amounts specified therefor, can also be suitable for the second layer insulation. The same applies for the compatibilizer described in connection with the first layer of insulation.

The second layer of insulation can also include at least one crosslinking agent. In certain embodiments, the second layer of insulation can comprise from 0.1% to 1.0%, by weight, of the crosslinking agents; and in certain embodiments, the second layer of insulation can comprise from 0.4% to 0.7%, by weight, of the crosslinking agents. It will be appreciated that crosslinking agents suitable for the first layer of insulation can also be suitable for the second layer insulation.

In certain embodiments, the second layer of insulation can further include at least one reinforcement material. For example, suitable reinforcement materials can include mica; inorganic fibers, such as glass fibers; silicon dioxide, and titanium oxide. In certain embodiments, the second layer of insulation can comprise from 1% to 10%, by weight, of the reinforcement material; and in certain embodiments, the second layer of insulation can comprise from 3% to 8%, by weight, of the reinforcement material. In some embodiments, the reinforcement material can have a micrometric size.

Table 2 shows an example formulation of a second layer of insulation, prior to curing. Weight percentages of each component for the example first layer of insulation are listed.

TABLE 2

Second Layer Example

| Component | Amount (wt. %) |
|---|---|
| Silicone rubber | 92.1 |
| Flame retardant additive + compatibilizer | 1.06 |
| Peroxide crosslinking agent | 0.55 |
| E-Glass fiber | 1.77 |
| Muscovite Mica | 3.93 |
| Hydrogen Silicone oil | 0.55 |

Applicant has unexpectedly found that the dual arrangement for the insulation layers described herein can allow the cable to maintain circuit integrity during a two-hour burn test at a temperature of at least 1000° C. when tested according to UL 2196 (2012). The first layer of insulation can be positioned radially inward of the second layer of insulation due to its superior electrical properties. For example, Table 3 shows that when the respective, individual efficacies of the first layer example of Table 1 and the second layer example of Table 2 are compared, with respect to volume resistivity, the first layer example outperforms the second layer example. Further, the second layer of insulation can be positioned radially outward of the first layer of insulation due to its superior physical properties. Without wishing to be bound by theory, it is believed that, when used together, the layers can operate independently of the other and reduce the likelihood that fissures will open at the same points on the respective insulation layers, thereby allowing circuit integrity to be maintained at high temperatures.

TABLE 3

Comparison of Volume Resistivity for First and Second Layer Examples

| | Volume Resistivity (Ohm·m) | |
|---|---|---|
| Temperature (° C.) | First Layer Example | Second Layer Example |
| Room temperature | 3,030,303,030 | 1,479,500,891 |
| 450 | 909,091 | 369,875,223 |
| 750 | 303,030 | 1,849,376 |
| 870 | 151,515 | 369,875 |
| 900 | 60,606 | 18,494 |
| 950 | 9,091 | 1,849 |
| 970 | 3,030 | 1,295 |
| 1010* | 909 | 925 |

*Measurement may not be reliable at this temperature due to instrument limitations The first and second layers of insulation can be of any suitable thickness that allows the fire resistant cable to sufficiently maintain circuit integrity and meet desired standards as described above. In certain embodiments, each of the first and second insulation layers can have a thickness from 15 mils (about 0.4 mm) to 35 mils (about 0.9 mm). Additionally, both the first layer of insulation and the second layer of insulation can be crosslinked.

As shown in FIG. 1, a jacket layer 20 can surround the second layer of insulation 18. Moreover, the jacket layer can be in direct contact with the underlying second layer of insulation. The jacket layer can be formed of a LSOH jacket composition. For example, in certain embodiments, the LSOH jacket composition can comprise a polymer material selected from a polyolefin, such as polyethylene (e.g., linear-low-density polyethylene ("LLDPE"), low-density polyethylene ("LDPE"), medium-density polyethylene ("MDPE"), high-density polyethylene ("HDPE")), polypropylene, and ethylene vinyl acetate ("EVA"), and mixture thereof. In certain embodiments, the jacket composition can comprise from 35% to 80%, by weight, of the polymer material; and in certain embodiments, the jacket composition can comprise from 40% to 70%, by weight, of the polymer material. In certain embodiments, the polymer material can be crosslinked by peroxide and/or silane crosslinking or other known methods.

The jacket composition can also include an inorganic halogen-free flame retardant filler. In certain embodiments, the inorganic halogen-free flame retardant filler can comprise at least one of aluminum hydroxide or magnesium hydroxide, both of synthetic (precipitated) or natural origin (brucite). In certain embodiments, the jacket composition can comprise from 30% to 70%, by weight, of the inorganic halogen-free flame retardant filler; in certain embodiments, the jacket composition can comprise from 50% to 70%, by weight, of the inorganic halogen-free flame retardant filler;

and in certain embodiments, the jacket composition can comprise from 55% to 65%, by weight, of the inorganic halogen-free flame retardant filler.

As with the first and second layers of insulation, the jacket composition can include crosslinking agents. For example, the jacket composition can include peroxide crosslinking agents as described herein. Further, the jacket composition described herein can include silane coupling agents. Generally, examples of suitable silane coupling agents can include one or more of a monomeric vinyl silane, an oligomeric vinyl silane, a polymeric vinyl silane, and an organosilane compound. Examples of suitable organosilane compounds can include γ-methacryloxypropyltrimethoxysilane, methyltriethoxysilane, methyltris(2-methoxyethoxy) silane, dimethyldiethoxysilane, vinyltris(2-methoxyethoxy) silane, vinyltrimethoxysilane, vinyltriethoxysilane, octyltriethoxysilane, isobutyltriethoxysilane, isobutyltrimethoxysilane, propyltriethoxysilane, vinyl triacetoxy silane, and mixtures or polymers thereof.

The jacket composition can also include an antioxidant. According to certain embodiments, suitable antioxidants for inclusion in the composition can include, for example, amine-antioxidants, such as 4,4'-dioctyl diphenylamine, N,N'-diphenyl-p-phenylenediamine, and polymers of 2,2,4-trimethyl-1,2-dihydroquinoline; phenolic antioxidants, such as thiodiethylene bis[343,5-di-tert-butyl-4-hydroxyphenyl) propionate], 4,4'-thiobis(2-tert-butyl-5-methylphenol), 2,2'-thiobis(4-methyl-6-tert-butyl-phenol), benzenepropanoic acid, 3,5-bis(1,1-dimethylethyl)-4-hydroxy benzenepropanoic acid, 3,5-bis(1,1-dimethylethyl)-4-hydroxy-C13-15 branched and linear alkyl esters, 3,5-di-tert-butyl-4-hydroxyhydrocinnamic acid $C_{7-9}$-branched alkyl ester, 2,4-dimethyl-6-t-butylphenol-tetrakis {methylene-3-(3',5'-diter-t.butyl-4'-hydroxyphenol)propionate}methane or -tetrakis {methylene3-(3',5-ditert.butyl-4'-hydrocinnamate}methane, 1,1,3tris(2-methyl-4-hydroxyl-5-butylphenyl)butane, 2,5,di-tert. amyl hydroquinone, 1,3,5-trimethyl-2,4,6-tris(3,5diter-t.butyl-4-hydroxybenzyl)benzene, 1,3,5-tris(3,5-ditert-.butyl-4-hydroxybenzyl)isocyanurate, 2,2-methylene-bis-(4-methyl-6-tert.butyl-phenol), 6,6'-di-tert.butyl-2,2'-thio-di-p-cresol or 2,2'-thiobis(4-methyl-6-tert-butylphenol), 2,2-ethylenebis(4,6-di-t-butylphenol), triethyleneglycol bis {3-(3-tert.butyl-4-hydroxy-5-methylphenyl)propionate}, 1,3,5-tris(4-tert.butyl-3-hydroxy-2,6-dimethylbenzyl)-1,3,5-triazine-2,4,6-(1H,3H,5H)trione, 2,2-methylenebis {6-(1-methylcyclohexyl)-p-cresol}; sterically hindered phenolic antioxidants such as pentaerythritol tetrakis[3-(3,5-di-tert-.butyl-4-hydroxy-phenyl)propionate]; hydrolytically stable phosphite antioxidants such as tris(2,4-ditert.butyl-phenyl) phosphite; toluimidazole, and/or sulfur antioxidants, such as bis(2-methyl-4-(3-n-alkylthiopropionyloxy)-5-tert-.butylphenyl)sulfide, 2-mercaptobenzimidazole and its zinc salts, pentaerythritol-tetrakis(3-lauryl-thiopropionate), and combinations thereof. Antioxidants can be included in compositions at concentrations 5 parts, by weight, or less of the composition in certain embodiments; and from about 1 part to 3 parts, by weight, in certain embodiments. As can be appreciated, in certain embodiments, a blend of multiple antioxidants can be use.

Table 4 shows an example formulation of a jacket composition. Weight percentages of each component for an example jacket composition are listed.

TABLE 4

Jacket Composition Example

| Component | (wt %) |
|---|---|
| EVA (28% VA) | 37 |
| Precipitated Magnesium Hydroxide | 61 |
| Crosslinking agents | ~3 |
| Silane coupling agent | |
| Phenolic Antioxidant | |

The jacket layer described herein can serve as an additional flame barrier to the dual arrangement of the insulation layers to, among other things, further assist in allowing circuit integrity to be maintained at high temperatures. Furthermore, besides improving the mechanical protection of the cable, the jacket layer can facilitate the ability of the cable to meet wet electrical testing requirements, such as passing water penetration tests. In certain embodiments, the jacket layer can have a thickness from 10 mils (about 0.25 mm) to 35 mils (about 0.9 mm); and in certain embodiments, the jacket layer can have a thickness from 15 mils (about 0.4 mm) to 25 mils (about 0.6 mm).

As can be appreciated, the dual arrangement of the insulation layers and jacket layer described herein can optionally further include additional components. For example, each insulation layer or jacket layer can further include crosslinking agents, as described herein; antioxidants, as described herein; colorants; processing aids; and stabilizers in various embodiments. As can be appreciated, any of the additional components can be directly added to compositions forming the respective insulation layers or jacket layer described herein or can be introduced using a masterbatch. Generally, any additional components can be included at about 1% to about 10%, by weight, of the respective insulation layers or jacket layer.

A processing aid can be included to improve the processability of a composition. The processing oil can generally be a lubricant, such as ultra-low molecular weight polyethylene (e.g., polyethylene wax), stearic acid, silicones, anti-static amines, organic amities, ethanolamides, mono- and di-glyceride fatty amines, ethoxylated fatty amines, fatty acids, zinc stearate, stearic acids, palmitic acids, calcium stearate, zinc sulfate, oligomeric olefin oil, or combinations thereof. In certain embodiments, a lubricant can be included from about 1 part to about 3 parts, by weight, of the composition.

According to certain embodiments, the compositions described herein can include at least one of an ultraviolet ("UV") stabilizer, a light stabilizer, a heat stabilizer, and any other suitable stabilizer.

Suitable UV stabilizers can be selected from, for example, compounds including: benzophenones, triazines, banzoxazinones, benzotriazoles, benzoates, formamidines, cinnamates/propenoates, aromatic propanediones, benzimidazoles, cycloaliphatic ketones, formanilides, cyanoacrylates, benzopyranones, salicylates, and combinations thereof.

Hindered amine light stabilizers ("HALS") can be used as a light stabilizer according to certain embodiments. HALS can include, for example, bis(2,2,6,6-tetramethyl-4-piperidyl)sebacate; bis(1,2,2,6,6-tetramethyl-4-piperidyl)sebaceate with methyl 1,2,2,6,6-tet-rameth-yl-4-piperidyl sebacate; 1,6-hexanediamine, N,N'-bis(2,2,6,6-tetramethyl-4-pi-peridyl)polymer with 2,4,6 trichloro-1,3,5-triazine; reaction products with N-butyl-2,2,6,6-tetramethyl-4-piperidinamine; decanedioic acid; bis(2,2,6,6-tetramethyl-1-(octyloxy)-4-pi-peridyl)ester; reaction products with 1,1-dimethylethylhydroperoxide and octane; triazine derivatives; butanedioc acid; dimethylester, polymer with 4-hydroxy-2,2,6,6-tetramethyl-1-piperidine ethanol; 1,3,5-triazine-2,4,6-triamine,N,N'''-[1,2-ethane-diyl-bis[[[4,6-bis-[butyl-(1,2,2,6,6pentamethyl-4-piperadinyl)amino]-1,3,5-triazine-2-yl]imino-]-3,1-propanediyl]]bis-[N',N''-dibutyl-N',N'' bis(2,2,6,6-tetramethyl-4-piperidyl); bis(1,2,2,6,6-pentamethyl-4-piperidinyl) sebacate; poly[[6-[(1,1,3,3-terramethylbutyl)amino]-1,3,5-triazine-2,4-diyl][2,2,6,6-tetramethyl-4-piperidinyl)imino]-1,6-hexanediyl[(2,2,6,6-tetramethyl-4-piperidinyl)imino]]; benzenepropanoic acid; 3,5-bis(1,1-dimethyl-ethyl)-4-hydroxy-C7-C9 branched alkyl esters; and isotridecyl-3-(3,5-di-tert-butyl-4-hydroxy-phenyl) propionate.

Suitable heat stabilizers can include 4,6-bis(octylthiomethyl)-o-cresol dioctadecyl 3,3'-thiodipropionate; poly[[6-[(1,1,3,3-terramethylbutyl)amino]-1,3,5-triazine-2,4-diyl]-[2,2,6,6-tetramethyl-4-piperidinyl)imino]-1,6-hexanediyl [(2,2,6,6-tetramethyl-4-piperidinyl)-imino]]; benzenepropanoic acid; 3,5-bis(1,1-dimethyl-ethyl)-4-hydroxy-$C_7$-$C_9$ branched alkyl esters; and isotridecyl-3-(3,5-di-tert.butyl-4-hydroxyphenyl) propionate.

As can be appreciated, in certain embodiments, the layers described herein can be prepared by blending the above-described components in conventional masticating (blender) equipment, for example, a rubber mill, brabender mixer, banbury mixer, buss ko-kneader, farrel continuous mixer, or twin-screw continuous mixer. In certain examples, some of the components can be premixed before the addition of others. The mixing time can be selected to ensure a homogenous mixture.

The insulation layers described herein can be extruded around a conductor to form a fire resistant cable having advantageous properties. In the present method, at least one conductor can be provided, and the at least one conductor can be surrounded with at least one mica layer (e.g., in the form of a tape). In a typical extrusion method, an optionally heated conductor with at least one mica layer wound thereon can be advanced through a heated extrusion die to apply one or more layers of a melted desired composition around the at least one mica layer. In certain embodiments, such layers, including layers of insulation and a jacket layer, can be applied by consecutive extrusion steps in which one layer is added in each step. Upon exiting the die, the conductor with the one or more applied compositions can be passed through an optionally heated vulcanizing section, or continuous vulcanizing section and then a cooling section, generally an elongated cooling bath, to cool. In certain embodiments, the first layer of insulation and the second layer of insulation can be coextruded relative to each other. In certain embodiments, the first layer of insulation, the second layer of insulation, and the jacket layer are extruded simultaneously via triple coextrusion. After extrusion with a tandem extrusion die, multiple layers can then be optionally cured in a single curing step.

EXAMPLES

Tables 5 and 6 provide results for a two-hour burn test according to UL 2196 (2012). With respect to Table 5, Inventive Example 1 includes a cable with four mica layers and two insulation layers, where the first layer of insulation is the above-referenced First Layer Example (see Table 1), having a thickness of 0.635 mm (25 mils), and the second layer of insulation of the above-referenced Second Layer Example (see Table 2), having a thickness of 0.635 mm (25 mils), where the layers surround 2 wires in a 19.05 mm (0.75") conduit. Inventive Example 2 is the same as Inventive Example 1, except that the first layer of insulation has a thickness of 0.889 mm (35 mils) while the second layer of insulation has a thickness of 0.381 mm (15 mils).

TABLE 5

| Circuit | Temp. at Failure (° C.) | Inventive Example 1 | Inventive Example 2 |
|---|---|---|---|
| | | Time of Failure (min)* | |
| #1-1 | 1010 | 150 | 150 |
| #1-2 | 1010 | 143 | 150 |
| #2-1 | 1010 | 129 | 128 |
| #2-2 | 1010 | 129 | 128 |
| #3-1 | 1010 | 144 | 150 |
| #3-2 | 1010 | 150 | 132 |
| | Average | 140.8 | 139.7 |

*Failure times listed as "150" maintained integrity until the experiment was terminated at 150 minutes With respect to Table 6, Comparative Example 1 includes a cable with four mica layers and a single insulation layer, the above-referenced First Layer Example having a thickness of 1.143 mm (45 mils), and a jacket layer, formed from the above-referenced Jacket Composition Example (see Table 4) having a thickness of 0.381 mm (15 mils), where the layers surround 3 wires in a 19.05 mm (0.75") conduit. Comparative Example 2 is the same as Comparative Example 1.

TABLE 6

| | Comparative Example 1 | | Comparative Example 2 | |
|---|---|---|---|---|
| Circuit | Temp. at Failure (° C.) | Time of Failure (mm) | Temp. at Failure (° C.) | Time of Failure (min) |
| #1-1 | 1010 | 126 | 1008 | 115 |
| #1-2 | 1008 | 110 | 1010 | 132 |
| #1-3 | 1008 | 111 | 1007 | 111 |
| #2-1 | 1000 | 103 | 1008 | 112 |
| #2-2 | 980 | 97 | 1008 | 114 |
| #2-3 | 1009 | 114 | 1010 | 119 |
| #3-1 | 1008 | 109 | 1003 | 106 |
| #3-2 | 1000 | 105 | 1009 | 116 |
| #3-3 | 1010 | 125 | 1002 | 106 |
| Average | 1003.7 | 111.1 | 7.2 | 114.6 |

As shown in the Tables 5 and 6, Inventive Examples 1 and 2 outperform Comparative Examples 1 and 2. For example, all of the circuit runs for each of Inventive Examples 1 and 2 maintained integrity for at least two hours (120 minutes) at 1000° C. or greater. However, for each of Comparative Examples 1 and 2, only one circuit run out of nine maintained integrity for at least two hours (120 minutes) at 1000° C. or greater. The average time of failure for Comparative Example 1 was 111.1 minutes at an average temperature of failure of 1003.7° C., while the average time of failure for Comparative Example 2 was 114.6 minutes at an average temperature of failure of 1007.2° C. The dual layer insulation arrangement clearly outperformed a single-layer insulation arrangement, of nearly similar thickness, that also included a jacket layer.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art.

The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A fire resistant cable comprising:

at least one conductor;

at least one mica layer surrounding and in direct contact with the at least one conductor;

a first layer of insulation surrounding and in direct contact with the at least one mica layer, wherein the first layer of insulation is made of a composition based on a cured flame retardant ceramifiable silicone rubber; and a second layer of insulation surrounding the first layer of insulation, wherein the second layer of insulation is made of a composition based on a cured flame retardant ceramifiable silicone rubber comprising at least one reinforcement material selected from the group consisting of mica, inorganic fibers, silicon oxide, and titanium oxide.

2. The fire resistant cable of claim 1, further comprising a jacket layer surrounding the second layer of insulation.

3. The fire resistant cable of claim 2, wherein the jacket layer is in direct contact with the second layer of insulation.

4. The fire resistant cable of claim 2, wherein the jacket layer is formed from a low-smoke zero-halogen jacket composition.

5. The fire resistant cable of claim 4, wherein the jacket composition comprises a polymer material comprising at least one of polyethylene and ethylene vinyl acetate ("EVA").

6. The fire resistant cable of claim 5, wherein the jacket composition further comprises from about 40% to about 80%, by weight, of an inorganic halogen-free flame retardant filler.

7. The fire resistant cable of claim 2 maintains circuit integrity during a two-hour burn test at a temperature of at least 1000° C. or greater when tested according to Underwriters Laboratory ("UL") 2196 (2012).

8. The fire resistant cable of claim 1, wherein the at least one mica layer comprises two mica layers, such that when applied to the at least one conductors, adjacent windings of the mica layers have an overlap of about 25% or greater.

9. The fire resistant cable of claim 1, wherein the second layer of insulation is in direct contact with the first layer of insulation.

10. The fire resistant cable of claim 1, wherein the first layer of insulation and the second layer of insulation are crosslinked.

11. The fire resistant cable of claim 1, wherein the first layer of insulation and the second layer of insulation each have a thickness from about 15 mils (about 0.4 mm) to about 35 mils (about 0.9 mm).

12. A method of forming a fire resistant cable comprising providing at least one conductor;

surrounding the at least one conductor with at least one mica layer;

extruding a first layer of insulation around the at least one mica layer, the first layer of insulation being made of a composition based on a cured flame retardant ceramifiable silicone rubber; and extruding a second layer of insulation around the first layer of insulation, the second layer of insulation being formed from a cured flame retardant ceramifiable silicone rubber comprising at least one reinforcement material selected from the group consisting of mica, inorganic fibers, silicon oxide, and titanium oxide wherein extruding the first layer and extruding the second layer are concurrently carried out; and curing the first and second layer.

13. The method of claim 12, further comprising extruding a jacket layer around the second layer of insulation, wherein the first layer of insulation, the second layer of insulation, and the jacket layer are extruded simultaneously via triple extrusion curing the first and second layer.

* * * * *